United States Patent [19]

Meredith et al.

[11] Patent Number: 4,684,442

[45] Date of Patent: Aug. 4, 1987

[54] OXYGEN REACTOR DEAERATION TANK AND SYSTEM

[75] Inventors: Michael D. Meredith, Tacoma; Joseph M. Bentvelzen, Sumner; Marvin F. Jordan, Longview, all of Wash.

[73] Assignee: Weyerhaeuser Company, Tacoma, Wash.

[21] Appl. No.: 718,188

[22] Filed: Apr. 1, 1985

Related U.S. Application Data

[63] Continuation-in-part of Ser. No. 594,455, Mar. 29, 1984, abandoned.

[51] Int. Cl.[4] ..... D21C 9/10; D21C 11/06; B01D 19/00

[52] U.S. Cl. ..... 162/242; 55/177; 55/201; 55/204; 162/29; 162/57; 162/65; 162/380

[58] Field of Search ..... 55/176, 177, 201, 52, 55/203, 194, 204; 162/380, 29, 41, 57, 59, 1, 65, 37, 39

[56] References Cited

U.S. PATENT DOCUMENTS

| | | | |
|---|---|---|---|
| 3,421,622 | 1/1969 | Wurtmann | 55/194 |
| 3,832,276 | 8/1974 | Roymoulik et al. | 162/65 |
| 3,963,561 | 6/1976 | Richter | 162/17 |
| 4,209,359 | 6/1980 | Sethy | 162/29 |

OTHER PUBLICATIONS

MacGregor "The Deaeration of Paper, Paperboard and Hardboard Stock by the Deculator Process" Appita, vol. 22, No. 6, May 1969, pp. xvii–xxi.

*Paper,* vol. 184, No. 11, 1975, Dec. 8, 1975, pp. 667–668.

Jacobsson, "Complete Deaeration as a Basic Necessity: The Deculator System," *Paper,* Apr. 20, 1981, pp. 61–62, 64 and 67.

*Primary Examiner*—Steve Alvo

[57] ABSTRACT

A small deaeration tank which may be either at atmospheric pressure on under low pressure or vacuum and a system of operating this tank which allows pulp which has been treated with oxygen to be deaerated before being washed. A closed tank would allow steam or oxygen to be recovered. Preferably it would be the same diameter as an oxygen reactor so that it could be placed on top of the reactor and be supported by the reactor. It would have no moving parts, so there would be no need for motors to be mounted on or near the tank. The deaerator is a small open tank having an inlet pipe, an outlet pipe, and a tangential swirl inducing inlet pipe. The locations and sizes of these pipes provide optimum deaeration. The swirl inducing fluid is the filtrate from the washer after the oxygen bleach.

8 Claims, 4 Drawing Figures

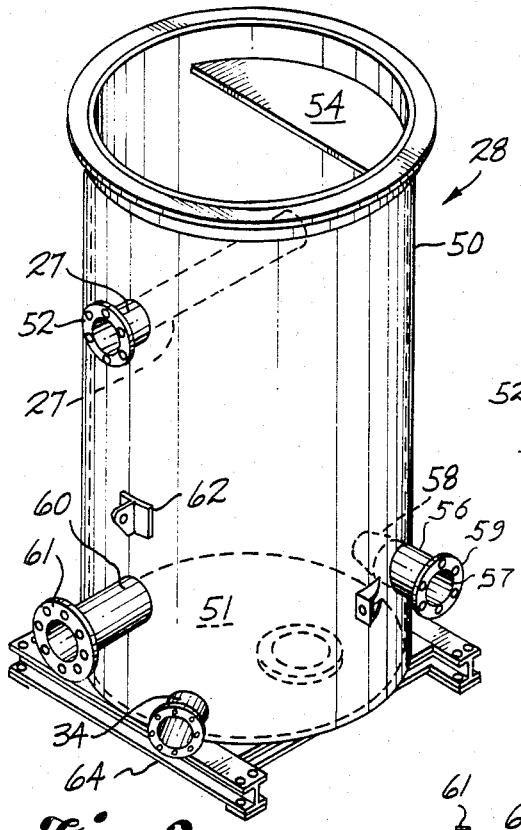
Fig. 2
Fig. 3
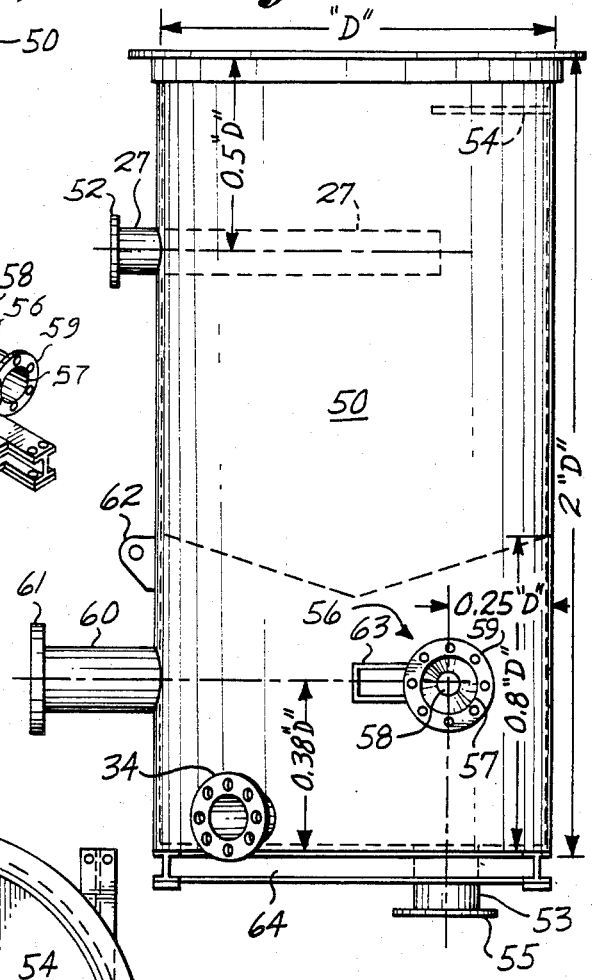
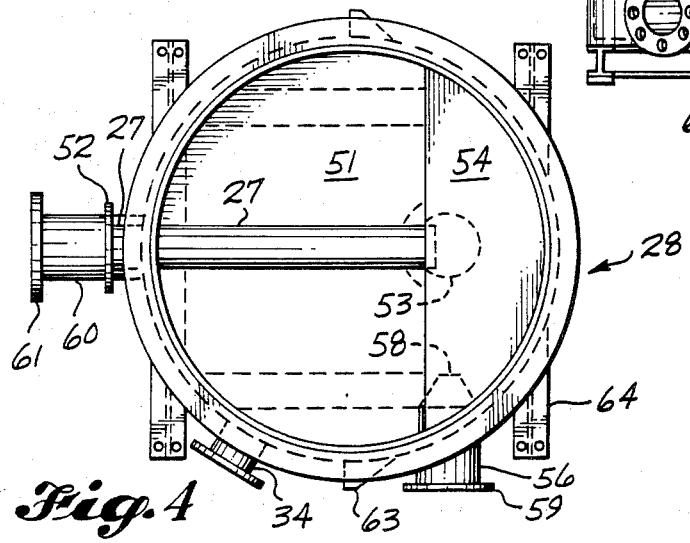
Fig. 4

OXYGEN REACTOR DEAERATION TANK AND SYSTEM

RELATED CASES

This is a continuation-in-part of our patent application Ser. No. 594,455 filed Mar. 29, 1984 now abandoned.

BACKGROUND OF THE INVENTION

One of the problems encountered when bleaching pulp with oxygen is attempting to wash the pulp after the oxygen stage. The oxygen entrained in the pulp mat reduces the vacuum on the vacuum washer and mixes with the wash water to form foam which reduces the vacuum in the washer and prevents the chemicals and water from passing through the mat.

There have been a number of proposals for the deaerating the pulp before the washer. One proposal is to use a "Deculator" process which is described by Mac Gregor, "The Deaeration of Paper, Paperboard and Hardboard Stock by the Deculator Process," Appita, Vol. 22, No. 6, May 1969, pp. xvii–xxi. It is also described in *Paper,* Vol. 184, No. 11, 1975, Dec. 8, 1975, pp. 667–668 and in Jacobsson, "Complete Deaeration as a Basic Necessity: The Deculator System," *Paper,* Apr. 20, 1981, pp. 61–62, 64, and 67. The process involves the rapid acceleration and spraying of stock into a long 6 foot diameter stainless steel receiver where it is boiled under vacuum while being impinged against a suitable target surface. This system involves expensive equipment, including vacuum systems and vacuum vessels.

Another system is described in Sethy, U.S. Pat. No. 4,209,359 issued Jun. 24, 1980. In this system the slurry, usually containing no more that 3% by weight of fiber, is agitated by a radial flow impeller which imparts a substantially radial flow to the slurry. Several types of impeller are shown.

Other large degassing chambers are shown in Roymoulik, et al. U.S. Pat. No. 3,832,276 granted Aug. 27, 1974, and in Richter, U.S. Pat. No. 3,963,561 granted Jun. 15, 1976. These are large expensive systems utilizing large tanks which must be built to withstand pressure. The Richter patent describes a large pressure vessel.

SUMMARY OF THE INVENTION

The inventors decided that there was a need for a small deaeration tank which may be at either atmospheric pressure of under low pressure or vacuum and a system of operating this tank which would allow pulp which had been treated with oxygen to be deaerated before being washed. Preferably it would be the same diameter as an oxygen reactor so that it could be placed on top of the reactor and be supported by the reactor. It would have no moving parts, so there would be no need for motors to be mounted on or near the tank. A closed tank would allow steam or oxygen to be recovered.

They devised a system in which the deaerator is a small tank having an inlet pipe, an outlet, and a tangential swirl inducing inlet pipe. The locations and sizes of these elements provide optimum deaeration.

In the system the swirl inducing fluid is the filtrate from the washer after the oxygen bleach.

BRIEF DESCRIPTION OF THE DRAWINGS

FIG. 2 is an isometric view of the deaeration tank.

FIG. 3 is a side plan view of the deaeration tank.

FIG. 4. is a top plan view of the deaeration tank.

DESCRIPTION OF THE PREFERRED EMBODIMENT

Figure 1:
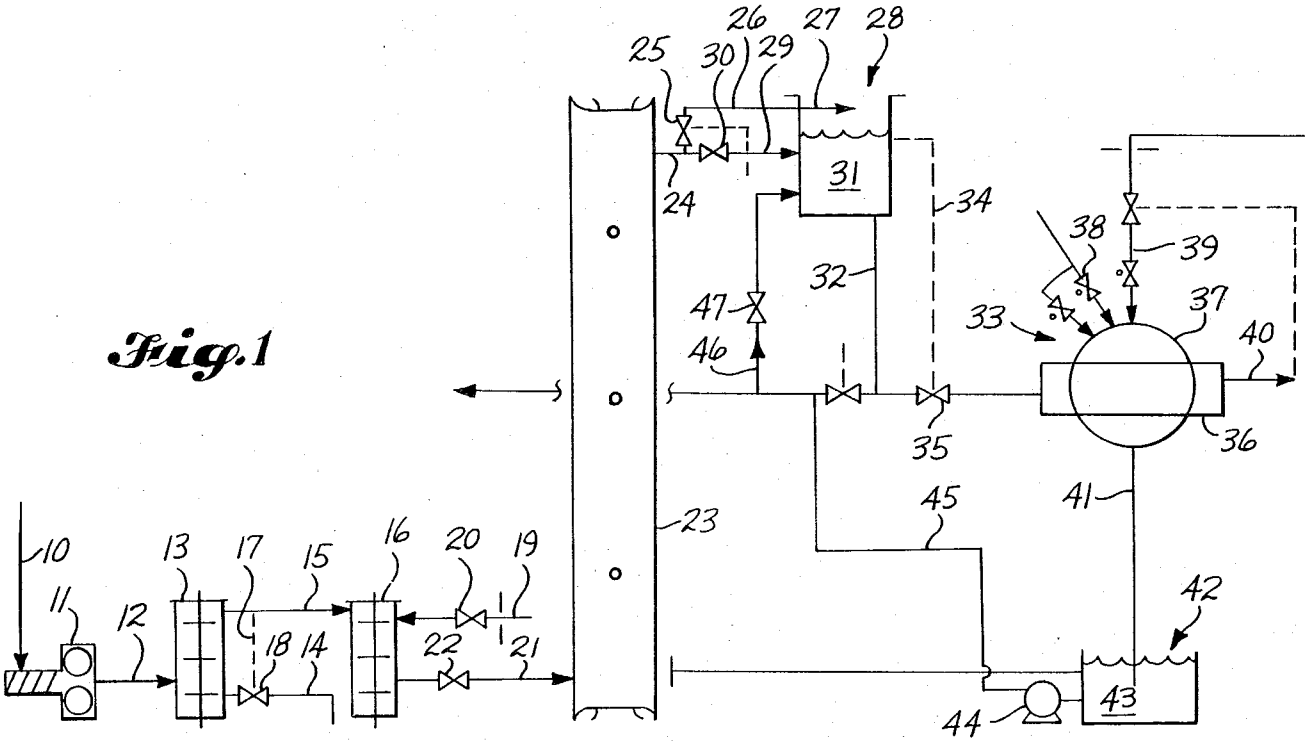
FIG. 1 is a diagramatic view of the oxygen reactor system from the inlet thick stock pump through the washer.

The overall oxygen process is shown in diagramatic form in FIG. 1. In this process, the pulp is carried through line 10 into thick stock pump 11 where it is forced through line 12 to steam mixer 13. In the steam mixer 13 steam from line 14 is combined with the pulp and heats the pulp. The heated pulp is carried through line 15 to oxygen mixer 16.

The temperature of the pulp in line 15 is sensed by temperature sensor 17. The sensor 17 operates valve 18 which controls the flow of steam through line 14. In oxygen mixer 16 the pulp is mixed with oxygen from line 19. The amount of oxygen added to the pulp is controlled by valve 20.

The oxygenated pulp is carried through line 21 and isolation valve 22 into a tower 23. The tower shown is an open tower and the only pressure within the tower is the hydrostatic head. However, if desired it may be a closed pressure tower.

From the top of the tower the oxygenated pulp is carried through line 24, valve 25 and line 26 to the oxygen deaeration tank inlet 27. Valve 25 is the pressure control valve. Although the pulp is at a consistency of 8–15% and usually 11–14%, it flows easily to the system because of the oxygen within the pulp.

Inlet 27 carries the pulp into the deaeration tank 28. An emergency line 29 with its valve 30 is also provided in case of an upset condition within the system. The valve 30 is normally closed. In an upset condition, the valve 25 would be closed and the valve 30 opened to carry the pulp directly into the tank. The deaerated pulp 31 in the deaeration tank 28 leaves through line 32 to pulp washer 33. The flow in the line 32 is controlled by the height of the pulp in the deaeration tank 28. The pulp is maintained at a constant height in the tank 28. Deaeration tank pulp height sensor 34 controls valve 35 in line 32. The pulp from line 32 enters the tank 36 of washer 33 and the pulp is picked up on drum 37. The mat on the drum 37 is washed by washer heads 38 and 39, dewatered by the vacuum drum 37 and the washed and dewatered pulp leaves the washer 33 at 40.

The filtrate from the pulp mat is carried through the mat into the drum 37 and through the drop leg 41 into the filtrate tank 42.

In the diagram a vacuum washer is shown in which the washer heads 38 carry fresh water and washer head 39 carries counterflow filtrate from a subsequent washer. The flow of counterflow filtrate in washer head 39 is controlled by a valve in the line which is controlled by the level in the filtrate tank of the subsequent washer.

The filtrate 43 in filtrate tank 42 is carried by pump 44 and counterflow line 45 to an earlier washer or decker to be used as wash water. Again the flow of filtrate in this line is controlled by the height of filtrate 43 in tank 42. The filtrate must be maintained at a predetermined height to maintain the vacuum in the washer 33.

Some of the filtrate from line 45 is carried by line 46 to the deaeration tank 28 to be used as the swirling fluid in the deaeration tank. A valve 47 controls the flow in line 46. The amount of filtrate flowing through line 46 will maintain the consistency of pulp in tank 28 at a pumpable consistency. The consistency should be between 1 and 5%. The best consistency is around 3%.

Pressure washers may be substituted for the vacuum washers shown.

The deaeration tank 28 is shown in FIG. 2–4. The deaeration tank 28 is shown as a cylindrical tank 50 having an open top and a flat bottom 51. The tank has an exterior diameter "D". The diameter of the deaeration tank would normally be the same size as the diameter of tank 23 so that it can be placed on top of or hung from the side of tank 23. The deaeration tank, however, may have a diameter of from 0.75 to 1.5 times the diameter of the tank 23. The tank normally has an exterior height of approximately 2"D". The tank should be high enough to prevent the swirling slurry within the tank from spilling over the sides. This height will depend upon the consistency of the pulp slurry. For pulp slurries in the range of 8–15% the exterior height of the tank should be between 1 and 337 D". The nominal height of the pulp slurry in the deaeration tank 28 is 0.8"D". The nominal height of the pulp slurry is the height of the slurry if it were at rest or as measured by its hydrostatic head or by a manometer. The slurry is actually swirling in the deaeration tank and its surface is dished with the center being lower than the nominal height and the periphery being higher than the nominal height. For diagramatic purposes the height of the slurry in FIG. 3 is shown as being between the bottom of the tank and the highest point of the slurry. This was only to illustrate that the dimension was between the bottom of the tank and the surface of the slurry. The dimension given, 0.8"D", is the nominal height of the slurry. The nominal height of the slurry may be between 0.4 and 1.0"D".

The inlet pipe 27 of the tank 28 has its center line between the upper surface of the slurry and the top edge of tank 50, and on a diameter line of the tank 50. The inlet pipe 27 should allow the pulp to enter the tank above the surface of the slurry and to splash against the side wall of the tank 50. The inlet pipe should be low enough in the tank to prevent the pulp from splashing from the tank. It would normally be located from the top of the tank a distance equal to 10–50% of the height of the tank. In a tank having a height of 2"D" and a nominal slurry height of 0.8"D", the horizontal center line of the inlet pipe would typically be approximately 0.5"D" below the upper edge of the tank 50. The inlet pipe extends across the interior the tank a distance greater than 0.5"D" to allow the incoming pulp to strike the side wall of the tank 50. It would usually extend across the tank approximately 0.75"D". Its length is actually slightly less than this because of its relationship with the outlet 53. Above the inlet pipe 27 and extending across the space between the end of inlet of pipe 27 and the opposing side wall of tank 50 is a splash plate 54. The inlet pipe 27 has an outer flange 52 which connects with a flange on pipe 26. The outside diameter of the inlet pipe 27 is between 0.07 and 0.16"D". The usual outside diameter is approximately 0.095"D⇄.

The tank 28 may be closed and be a pressure or vacuum tank. It will be closed if the oxygen or steam is being recovered. It would be built to withstand pressures of ±1 atmosphere.

The outlet 53 is located in the bottom plate 51 of the deaeration tank 28. Again the outlet 53 will be sized to handle the amount of pulp leaving the tank. This will be greater than the inlet pipe because recycled filtrate is added to the slurry in the tank 50. The outlet 53 has an outside diameter of between 0.12 and 0.2"D". The usual outside diameter of the outlet is approximately 0.14"D". The outlet 53 has a center line located in the same vertical plane as the center line of the inlet line 27. The center line of the outlet 53 is also located between 0.15 and 0.4"D", usually approximately 0.25"D", from the outside of the tank 50 directly below the outlet of inlet pipe 27. As can be seen in FIG. 4, the exact location of the outlet of inlet pipe 27 is along a chord line of the outlet 53. This chordline is approximately the diameter of the inlet pipe 27. The outlet 53 has a flange 55 which attaches to a flange on line 32.

The oxygen filled slurry is carried into the tank by the inlet pipe 27 and splashes against the side of the tank 50 opposite the inlet and drains down to the body of the slurry in the tank 28.

The height of slurry in tank 50 is controlled by the height sensor 34 at the bottom of the tank. The sensor 34 is at an angle of about 60° C. from the center line of the inlet pipe 27. The sensor controls the flow in outlet pipe 32 by operating the valve 25 between the deaeration tank and the washer.

The body of slurry in tank 28 is swirled by filtrate from washer 33. The velocity of filtrate entering the deaeration tank 28 is 6.1 meters per second (20 feet per second), at a 2% pulp consistency. The velocity may range from 4.57 to 12.19 meters per second (15 to 40 feet per second). This filtrate enters the tank through the filtrate swirler inlet 56. The filtrate swirler inlet 56 has a vertical center line that is between the bottom of the tank 50 and the surface of the slurry. It usually would be located from the bottom of the tank a distance equal to one-half of the distance between the bottom of the tank and the nominal height of the pulp slurry. In a tank in which the nominal height of the slurry is 0.8"D" the vertical center line of the filtrate inlet 56 would be 0.4"D". It is preferred that the filtrate swirl inlet be located from the bottom of the tank a distance equal to 10–25% of the height of the tank. The horizontal center line of the filtrate swirler-inlet 56 is between a tangent to the tank 50 and a radial line of the tank 50 that is perpendicular to the radial line passing through the tangent point. It should be placed off a radial line to provide a swirl to the slurry, and off a tangent to allow easier construction. It usually is placed in the same vertical plane as the center line of outlet 53. The filtrate inlet 56 has a diameter at its outer end 57 of from 0.07 to 0.16"D", usually 0.095"D", and necks down to a diameter at its inner end 58 of from 0.02 to 0.04, usually 0.028"D". This construction accelerates the filtrate to the required velocity as it enters the tank 28. The filtrate inlet has a flange 59 at its outer end which attaches to a flange on line 46.

The emergency bypass line 60 also has its center line between the bottom of the tank 50 and the upper surface of the slurry. It also would usually be placed one-half of the way between the bottom of the tank and the nominal height of the slurry. In a tank having a nominal slurry height of 0.8"D" it would usually be 0.4"D" from the bottom of the deaeration tank 28. It is in vertical alignment with the inlet pipe 27 and has a diameter of 0.12 to 0.2"D". It usually has a diameter of approximately 0.14"D". The flange 61 attaches to a flange on line 29.

Mounting brackets 62 and 63 and a mounting platform 64 are also shown.

A 50 ton of pulp per day installation has a tank with an outside diameter of 106.68 cm (42") and a height of 211.46 cm (83¼"). The inlet pipe is 53.34 cm (21") from the top of the tank. The outlet is 26.67 cm (10.5") from the center of the tank. The outside diameter of the inlet pipe is 10.16 cm (4"), of the outlet is 15.24 cm (6"), of the outer part of the filtrate inlet is 10.16 cm (4"), of the outlet of the filtrate inlet is 3.05 cm (1.2"), and of the bypass line is 15.24 cm (6").

We claim:

1. A system for deaerating oxygen from pulp comprising means for reacting oxygen with pulp, an outlet from said reacting means, a deaeration tank, said deaeration tank having a height in the range of 1 to 3"D", said deaeration tank having a first inlet pipe at the upper part of said deaeration tank, said fist inlet pipe extending across said tank along a diameter of said tank and extending into said tank a distance greater that 0.5"D", said first inlet pipe being located from the top of said tank a distance in the range of 10–50% of the height of said tank an outlet at the bottom of said deaeration tank and a second swirl inducing inlet pipe in the lower part of said deaeration tank, said second inlet pipe being located between a tangent to the tank and a radial line of the tank 90° C. from said tangent, said second inlet pipe being located above the bottom of the tank a distance in the range of 15–25% of the height of the tank, said second inlet pipe decreasing in diameter from an end of the pipe outside the tank to an end of the pipe inside the tank, means connecting the outlet of said reacting means to said first inlet pipe of said deaeration tank, a washer for separating a pulp slurry into a pulp and a filtrate, means connecting said deaeration tank outlet to the inlet of said washer, means for recycling filtrate from said washer, means connecting said filtrate recycle means with said second inlet pipe of said deaeration tank.

2. The system of claim 1 in which said deaeration tank is closed at its base and open at its top.

3. The system of claim 1 in which said deaeration tank is closed at the top.

4. A deaerator comprising a tank, said tank being closed at its base and having a diameter "D", said tank having a height in the range 1 to 3"D", a first inlet pipe on said tank, said first inlet pipe extending across said tank along a diameter and extending into said tank greater than 0.5"D", a splash plate located on a wall of the tank opposite said first inlet pipe, said first inlet pipe being located in the range of 10–50% of the height of said tank from the top of the tank and having diameter of 0.07–0.161 "D", an outlet to said tank at the base of said tank, a seconId inlet pipe on the side of the tank, said second inlet pipe extending in a direction that is between a tangent to the tank and a radial line of the tank 90° from said tangent, said second inlet pipe being located in the range of 15–25% of the height of the tank above the bottom of the tank, said tank outlet, said outlet of said first inlet pipe and said outlet of said second inlet pipe being in the same vertical plane.

5. The deaerator of claim 4 in which said outlet is located approximately 0.25"D" from the wall opposite said first inlet pipe outlet.

6. The deaerator of claim 4 in which said tank has a height of approximately 2"D", said first inlet pipe has a horizontal center line located approximately 0.5"D" from the top of said tank, said second inlet pipe has a center line approximately midway between said radial line and said tangent and approximately 0.4"D" from the bottom of said tank.

7. The deaerator of claim 4 in which said tank is open at the top.

8. The deaerator of claim 4 in which said tank is closed at the top.

* * * * *

UNITED STATES PATENT AND TRADEMARK OFFICE

CERTIFICATE OF CORRECTION

PATENT NO. : 4,684,442

DATED : Aug. 4, 1987

INVENTOR(S) : Michael D. Meredith, Joseph M. Bentvelzen, Marvin F. Jordan

It is certified that error appears in the above-identified patent and that said Letters Patent is hereby corrected as shown below:

In column 3, line 24, "337D" should read --"3D"--

In column 4, line 26, "60° C." should read --60°--

In column 5, line 37, 90° C." should read --90°--

Signed and Sealed this

Fifth Day of April, 1988

*Attest:*

*Attesting Officer*

DONALD J. QUIGG

*Commissioner of Patents and Trademarks*